US011417303B2

(12) United States Patent
Kanada et al.

(10) Patent No.: US 11,417,303 B2
(45) Date of Patent: Aug. 16, 2022

(54) MUSICAL SOUND DATA REPRODUCTION DEVICE AND MUSICAL SOUND DATA REPRODUCTION METHOD

(71) Applicant: YAMAHA CORPORATION, Hamamatsu (JP)

(72) Inventors: Suzumi Kanada, Hamamatsu (JP); Tsukasa Yamashita, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 243 days.

(21) Appl. No.: 16/810,926

(22) Filed: Mar. 6, 2020

(65) Prior Publication Data

US 2020/0202827 A1 Jun. 25, 2020

Related U.S. Application Data

(63) Continuation of application No. PCT/JP2017/032718, filed on Sep. 11, 2017.

(51) Int. Cl.
*G10H 1/34* (2006.01)
*G10H 1/00* (2006.01)

(52) U.S. Cl.
CPC ..... *G10H 1/34* (2013.01); *G10H 1/0025* (2013.01); *G10H 2220/231* (2013.01)

(58) Field of Classification Search
CPC ... G10H 1/34; G10H 1/0025; G10H 2220/231
See application file for complete search history.

(56) References Cited

U.S. PATENT DOCUMENTS 5,496,963 A * 3/1996 Ito ..... G10H 1/186 84/478
2010/0175540 A1* 7/2010 Ikeya ..... G09B 15/002 84/613

FOREIGN PATENT DOCUMENTS

JP S6398597 U 6/1988
JP H03213897 A 9/1991
JP H0566773 A 3/1993
(Continued)

OTHER PUBLICATIONS

Office Action issued in Japanese Appln. No. 2019-540743 dated Dec. 8, 2020. English machine translation provided.
(Continued)

*Primary Examiner* — Jianchun Qin
(74) *Attorney, Agent, or Firm* — Rossi, Kimms & McDowell LLP

(57) ABSTRACT

In a performance operator group, a partial region including at least one first performance operator and at least one second performance operator is set as a first key region. An allocator allocates musical sound data to the first key region. An operation detector detects an operation using each of the plurality of first and second performance operators of the performance operator group. A reproduction controller carries out first control relating to a reproduction method of the allocated musical sound data in response to detection of an operation using one of the first and second performance operators in the first key region, and carries out second control relating to the reproduction method of the allocated musical sound data and being different from the first control in response to detection of an operation using another one of the first and second performance operators in the first key region.

17 Claims, 12 Drawing Sheets

(56) References Cited

FOREIGN PATENT DOCUMENTS

| | | | | |
|---|---|---|---|---|
| JP | H10260683 | A | 9/1998 | |
| JP | 2002182648 | A | 6/2002 | |
| JP | 2003029757 | A | 1/2003 | |
| JP | 2005070167 | A | 3/2005 | |
| JP | 4107107 | B2 * | 6/2008 | ..... G10H 1/18 |
| JP | 5387182 | B2 | 1/2014 | |

OTHER PUBLICATIONS

International Search Report issued in International Application No. PCT/JP2017/032718 dated Nov. 7, 2017. English translation provided.
Written Opinion issued in International Application No. PCT/JP2017/032718 dated Nov. 7, 2017.

* cited by examiner

FIG. 4

KEY REGION INFORMATION

| KEY NUMBER | KEY REGION | MUSICAL PERFORMANCE DATA SET |
|---|---|---|
| 28 | CHORD DETECTION KEY REGION CD | |
| 29 | | |
| ⋮ | | |
| 52 | | |
| 53 | PITCH SHIFT KEY REGION N1 | INTERVAL MUSICAL PERFORMANCE DATA SET PA |
| 54 | | |
| ⋮ | | |
| 83 | | |
| 84 | RHYTHM KEY REGION D1 | RHYTHM MUSICAL PERFORMANCE DATA SET P1 |
| 85 | | |
| 86 | | |
| ⋮ | ⋮ | |
| 101 | RHYTHM KEY REGION D6 | RHYTHM MUSICAL PERFORMANCE DATA SET P6 |
| 102 | | |
| 103 | | |

MUSICAL SOUND DATA REPRODUCTION DEVICE AND MUSICAL SOUND DATA REPRODUCTION METHOD

BACKGROUND OF THE INVENTION

Field of the Invention

The present invention relates to a musical sound data reproduction device and a musical sound data reproduction method for reproducing musical sound data.

Description of Related Art

Conventionally, electronic musical instruments in which a rhythm sound of a bass drum, a snare drum and the like can be allocated to respective keys of a keyboard have been known. For example, in an electronic musical instrument described in JP 3-213897 A, a normal keyboard sound or a rhythm sound is respectively allocated to a plurality of key regions of the keyboard. A user can select to generate the normal keyboard sound or the rhythm sound in each key region.

BRIEF SUMMARY OF THE INVENTION

In the electronic musical instrument described in the above-mentioned JP 3-213897 A, the user can generate the normal keyboard sound or the rhythm sound by operating a key in each key region. However, it is desirable that the user can easily switch the control relating to the reproduction method such as starting or stopping loop reproduction during musical performance.

An object of the present invention is to provide a musical sound data reproduction device and a musical sound data reproduction method for enabling easy switch of control relating to a reproduction method of musical sound data during musical performance.

A musical sound data reproduction device according to one aspect of the present invention includes a keyboard-shaped performance operator group that has a plurality of first and second performance operators respectively corresponding to a plurality of black and white keys and being arranged in a row, and in which a partial region including at least one first performance operator and at least one second performance operator is set as a first key region, an allocator configured to allocate musical sound data to the first key region, an operation detector configured to detect an operation using each of the plurality of first and second performance operators of the performance operator group, and a reproduction controller configured to carry out first control (a first reproduction mode) relating to a reproduction method of the allocated musical sound data in response to detection of an operation using one of the first and second performance operators in the first key region, and carry out second control (a second reproduction mode) relating to the reproduction method of the allocated musical sound data and being different from the first control in response to detection of an operation using another one of the first and second performance operators in the first key region.

In an embodiment, the musical sound data may include musical sound data that is reproducible on a loop, and each of the first control and second control relating to a reproduction method of the musical sound data may include any one of starting of loop reproduction of the musical sound data, starting of one-time reproduction of the musical sound data, stopping of the loop reproduction of the musical sound data and stopping of the one-time reproduction of the musical sound data.

In an embodiment, the performance operator group may include a second key region that includes a plurality of first and second performance operators corresponding to different pitches and is set in a region different from the first key region, the allocator may be configured to allocate musical sound data to the second key region, the reproduction controller may be configured to shift a pitch of the allocated musical sound data based on a pitch corresponding to an operated first or second performance operator, and reproduce musical sound data having the shifted pitch, in response to detection of an operation using each of the plurality of first and second performance operators in the second key region.

In an embodiment, the first key region may be set in a sound region higher than a sound region of the second key region in the performance operator group.

In an embodiment, the performance operator group may include a third key region, which includes a plurality of first and second performance operators corresponding to different pitches and is settable in a region different from the first and second key regions, and the reproduction controller may be configured to detect a chord on the basis of a pitch corresponding to an operated first or second performance operator, and reproduce musical sound data on the basis of the detected chord, in response to detection of an operation using each of the plurality of first and second performance operators in the third key region.

In an embodiment, the musical sound data reproduction device may further include a determiner configured to determine whether the musical sound data allocated to the first key region is reproducible on a loop, wherein each of the first and second performance operators may be configured to be switched between an ON state and an OFF state by an operation using the performance operator, and the reproduction controller may be configured to carry out the first control based on a result of determination by the determiner and a manner in which a state of the one performance operator changes, and carry out the second control based on a result of determination by the determiner and a manner in which a state of the other performance operator changes.

In an embodiment, the reproduction controller, in a case where it is determined that musical sound data is reproducible on a loop, may be configured to start loop reproduction of the musical sound data in response to first switching of the one performance operator to the ON state, and stop the loop reproduction of the musical sound data in response to second switching of the one performance operator to the ON state.

In an embodiment, the reproduction controller, in a case where it is determined that musical sound data is reproducible on a loop, may be configured to perform loop reproduction of the musical sound data while the other performance operator is being kept in the ON state, and stop the loop reproduction of the musical sound data in response to switching of the other performance operator to the OFF state.

A musical sound data reproduction device according to another aspect of the present invention includes a keyboard-shaped performance operator group that has a plurality of first and second performance operators respectively corresponding to a plurality of black and white keys and being arranged in a row, and in which a partial region including at least one first performance operator and at least one second performance operator is set as a first key region, and a hardware processor configured to allocate musical sound data to the first key region, detect an operation using each of the plurality of first and second performance operators of the performance operator group, and carry out first control relating to a reproduction method of the allocated musical sound data in response to detection of an operation using one of the first and second performance operators in the first key region, and carry out second control (a second reproduction mode) relating to the reproduction method of the allocated musical sound data and being different from the first control (a first reproduction mode) in response to detection of an operation using another one of the first and second performance operators in the first key region.

A musical sound data reproduction method according to another aspect of the present invention includes allocating musical sound data to a first key region that includes at least one first performance operator and at least one second performance operator in a keyboard-shaped performance operator group having a plurality of first and second performance operators that respectively correspond to a plurality of black and white keys and are arranged in a row, detecting an operation using each of the plurality of first and second performance operators of the performance operator group, and carrying out first control (a first reproduction mode) relating to a reproduction method of the allocated musical sound data in response to detection of an operation using one of the first and second performance operators in the first key region, and carrying out second control (a second reproduction mode) relating to the reproduction method of the allocated musical sound data and being different from the first control in response to detection of an operation using another one of the first and second performance operators in the first key region.

In an embodiment, the musical sound data may include musical sound data that is reproducible on a loop, and each of the first control and second control relating to a reproduction method of the musical sound data may include any one of starting of loop reproduction of the musical sound data, starting of one-time reproduction of the musical sound data, stopping of the loop reproduction of the musical sound data and stopping of the one-time reproduction of the musical sound data.

In an embodiment, the performance operator group may include a second key region that includes a plurality of first and second performance operators corresponding to different pitches and is set in a region different from the first key region, the allocating includes allocating musical sound data to the second key region, and the musical sound data reproduction method may further include shifting a pitch of the allocated musical sound data based on a pitch corresponding to an operated first or second performance operator, and reproducing musical sound data having the shifted pitch, in response to detection of an operation using each of the plurality of first and second performance operators in the second key region.

In an embodiment, the first key region may be set in a sound region higher than a sound region of the second key region in the performance operator group.

In an embodiment, the performance operator group may include a third key region, which includes a plurality of first and second performance operators corresponding to different pitches and is settable in a region different from the first and second key regions, and the musical sound data reproduction method may further include detecting a chord on the basis of a pitch corresponding to an operated first or second performance operator, and reproducing musical sound data on the basis of the detected chord, in response to detection of an operation using each of the plurality of first and second performance operators in the third key region.

In an embodiment, the musical sound data reproduction method may further include determining whether the musical sound data allocated to the first key region is reproducible on a loop, wherein each of the first and second performance operators may switch between an ON state and an OFF state by an operation using the performance operator, and the carrying out the first control and the second control may include carrying out the first control based on a result of the determination and a manner in which a state of the one performance operator changes, and carrying out the second control based on a result of the determination and a manner in which a state of the other performance operator changes.

In an embodiment, the musical sound data reproduction method, in a case where it is determined that musical sound data is reproducible on a loop, may further include starting loop reproduction of the musical sound data in response to first switching of the one performance operator to the ON state, and stopping the loop reproduction of the musical sound data in response to second switching of the one performance operator to the ON state.

In an embodiment, the musical sound data reproduction method may further include, in a case where it is determined that musical sound data is reproducible on a loop, performing loop reproduction of the musical sound data while the other performance operator is being kept in the ON state, and stopping the loop reproduction of the musical sound data in response to switching of the other performance operator to the OFF state.

Other features, elements, characteristics, and advantages of the present invention will become more apparent from the following description of preferred embodiments of the present invention with reference to the attached drawings.

BRIEF DESCRIPTION OF THE SEVERAL VIEWS OF THE DRAWING

FIG. 4 is a diagram showing one example of key region information;

FIG. 7 is a flow chart showing first reproduction control to be carried out in case of detection of a note-on;

FIG. 8 is a flow chart showing second reproduction control to be carried out in case of detection of a note-on;

FIG. 9 is a flow chart showing third reproduction control to be carried out in case of detection of a note-on;

DESCRIPTION OF THE PREFERRED EMBODIMENTS

A musical sound data reproduction device and a musical sound data reproduction method according to embodiments of the present invention will be mentioned below in detail with reference to the drawings.

(1) Configuration of Electronic Musical Apparatus

Figure 1:
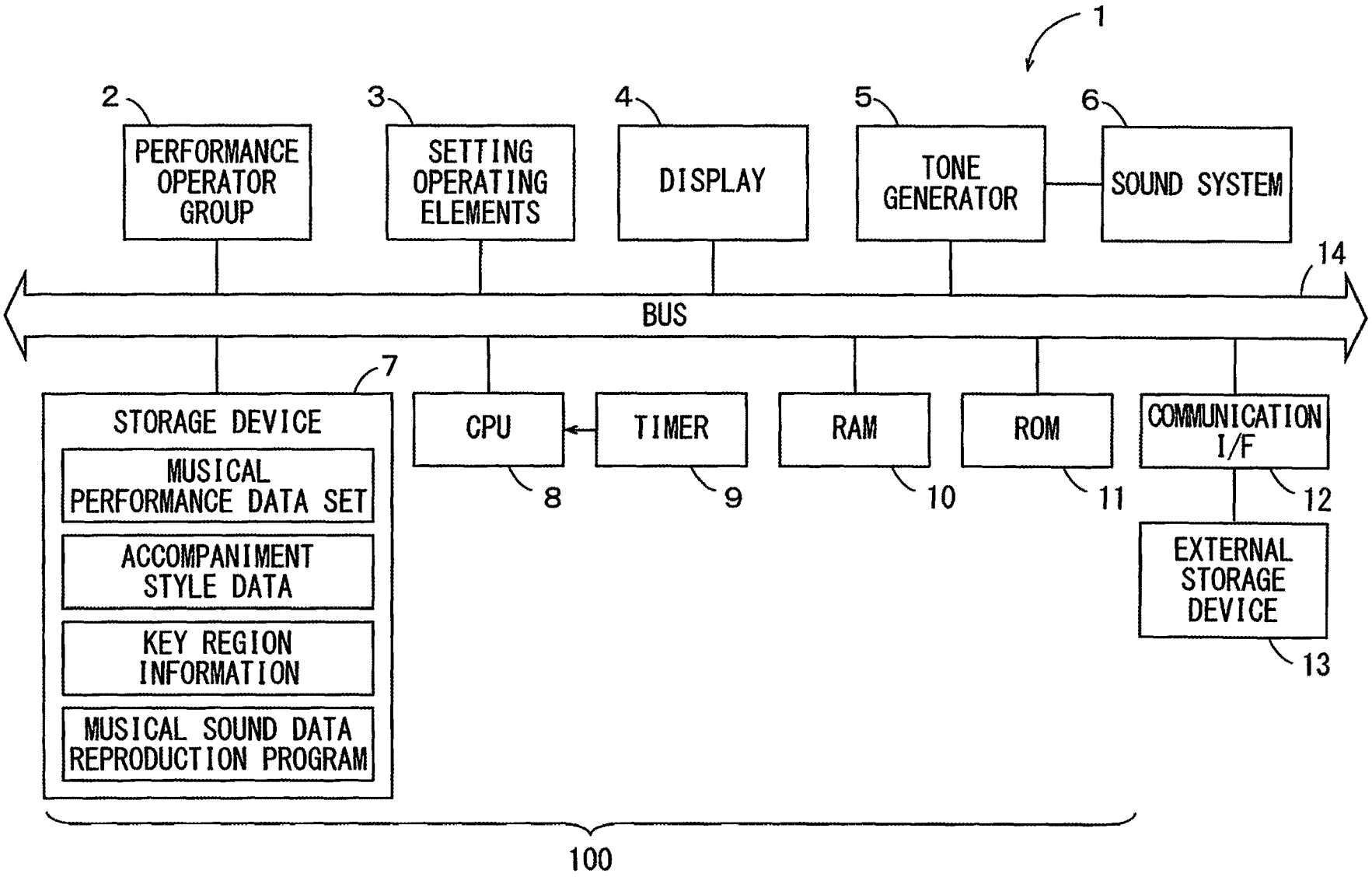
FIG. 1 is a block diagram showing the configuration of an electronic musical apparatus including a musical sound data reproduction device according to one embodiment of the present invention.

FIG. 1 is a block diagram showing the configuration of an electronic musical apparatus including a musical sound data reproduction device according to one embodiment of the present invention.

The electronic musical apparatus 1 of FIG. 1 is an electronic keyboard musical instrument, for example. The electronic musical apparatus 1 includes a performance operator group 2, setting operating elements 3 and a display 4. In the present embodiment, the performance operator group 2 has a plurality of first and second performance operators that respectively correspond to a plurality of black and white keys and are arranged in a row, and is connected to a bus 14. The plurality of first and second performance operators of the performance operator group 2 may be images of a plurality of black and white keys displayed on a screen of a touch panel mentioned below.

The setting operating elements 3 include operation switches that are operated in an on-off manner, operation switches that are operated in a rotational manner, operation switches that are operated in a sliding manner, etc., and are connected to the bus 14. The setting operating elements 3 are used for setting a key region and allocating musical performance data sets, mentioned below, adjusting volume, on-off of a power supply and various settings. The display 4 includes a liquid crystal display, for example, and is connected to the bus 14. A name of a musical piece, a music score or other various information is displayed on the display 4. The display 4 may be a touch panel display. In this case, part or all of the performance operator group 2 or the setting operating elements 3 may be displayed on the display 4. A user can provide instructions for various operations by operating the display 4.

The electronic musical apparatus 1 includes a tone generator 5 and a sound system 6. The tone generator 5 is connected to the bus 14, and generates audio data (an audio signal) based on musical sound data and the like reproduced by an operation of the performance operator group 2. The audio data is sampling data representing the waveform of a sound. The sound system 6 includes a digital-analogue (D/A) conversion circuit, an amplifier and a speaker. The sound system 6 converts the audio data supplied from the tone generator 5 into an analogue sound signal and generates a sound on the basis of the analogue sound signal.

The electronic musical apparatus 1 further includes a storage device 7, a CPU (Central Processing Unit) 8, a timer 9, a RAM (Random Access Memory) 10, a ROM (Read Only Memory) 11 and a communication I/F (Interface) 12. The storage device 7, the CPU 8, the RAM 10, the ROM 11 and the communication I/F 12 are connected to the bus 14. The timer 9 is connected to the CPU 8. An external apparatus such as an external storage device 13 may be connected to the bus 14 via the communication I/F 12.

The storage device 7 includes a storage media such as a hard disc, an optical disc, a magnetic disc or a memory card. In this storage device 7, musical performance data sets representing musical performance sounds of a musical instrument and accompaniment style data for an automatic accompaniment are stored, and key region information is stored. In the present embodiment, the musical sound data includes the musical performance data sets and automatic accompaniment data mentioned below. The musical sound data may be audio data or MIDI (Musical Instrument Digital Interface) data. The key region information will be mentioned below. Further, a computer program such as a musical sound data reproduction program is stored in the storage device 7.

The RAM 10 is a volatile memory, for example, which is used as a working area for the CPU 8, and temporarily stores various data. The ROM 11 is a nonvolatile memory, for example, and stores a control program. The ROM 11 may store a computer program such as a musical sound data reproduction program. The CPU 8 executes the musical sound data reproduction program stored in the storage device 7 or the ROM 11 to perform the musical sound data reproduction method mentioned below. The timer 9 provides clock information indicating an elapse of time to the CPU 8. The storage device 7, the CPU 8, the timer 9, the RAM 10 and the ROM 11 constitute the musical sound data reproduction device 100.

The musical sound data reproduction program may be supplied in the form of being stored in a storing media which is readable by a computer, and installed in the storage device 7 or the ROM 11. Further, the musical sound data reproduction program may be stored in the external storage device 13. In addition, in a case where the communication I/F 12 is connected to a communication network, the musical sound data reproduction program delivered from a server connected to the communication network may be installed in the storage device 7 or the ROM 11.

(2) Key Regions of Performance Operator Group 2

Figure 2:
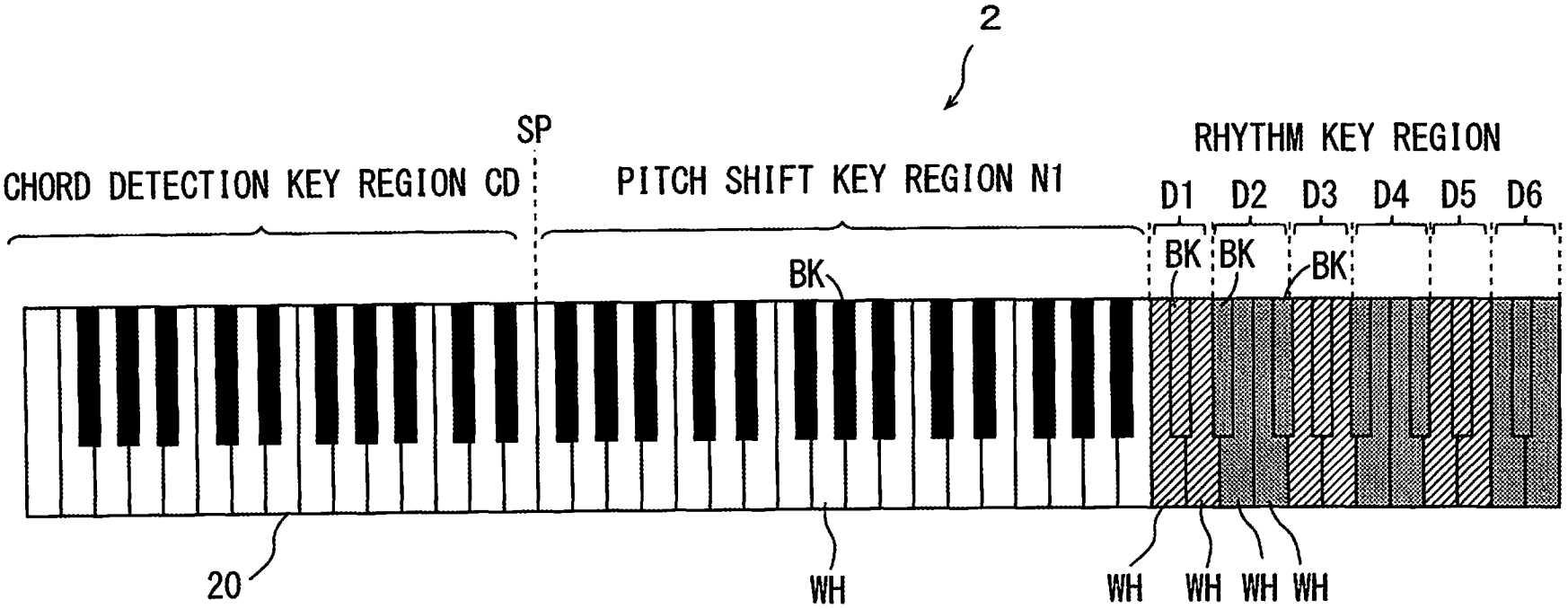
FIG. 2 is a schematic diagram showing key regions of a performance operator group of FIG. 1.

FIG. 2 is a schematic diagram showing key regions of the performance operator group 2 of FIG. 1. As shown in FIG. 2, the performance operator group 2 includes a keyboard 20 in the present embodiment. The keyboard 20 has a plurality of black keys BK and white keys WH that are arranged in a row. Pitches that ascend in order from the left to the right are assigned to the plurality of black keys BK and white keys WH arranged in a row.

A pitch shift key region N1 is set in a center portion of the keyboard 20, a plurality of rhythm key regions D1 to D6 are set in a right portion (a region in a higher sound range) of the keyboard 20, and a chord detection key region CD is set in a left portion (a region in a lower sound range) of the keyboard 20. A split point SP which is the boundary between the pitch shift key region N1 and the chord detection key region CD is set at any position by a user's operation of the setting operating elements 3. Each of the rhythm key regions D1 to D6 includes at least one black key BK and at least one white key WH. For example, the rhythm key region D1 includes one black key BK and two white keys WH, and the rhythm key region D2 includes two black keys BK and two white keys WH.

The musical performance data sets stored in the storage device 7 of FIG. 1 includes a plurality of types of musical performance data sets having change patterns which include a plurality of pitches changed with time, and a plurality of types of musical performance data sets having rhythm patterns such as drums. Hereinafter, in a case where both types of the musical performance data sets are distinguished from each other, the musical performance data set having a change pattern which includes a plurality of pitches changed with time is referred to as interval musical performance data sets, and the musical performance data set having a rhythm pattern is referred to as a rhythm musical performance data set. Each interval musical performance data set may include one or a plurality of pitches in each point in time. Here, repetitive reproduction of one musical performance data set is referred to as loop reproduction, and one-time reproduction of one musical performance data set is referred to as normal reproduction. Each of the musical performance data sets includes loopable data that can be reproduced on a loop, and non-loopable data that cannot be reproduced on a loop.

Any one of the plurality of types of rhythm musical performance data sets is allocated to each of the rhythm key regions D1 to D6. In the present embodiment, the rhythm musical performance data sets are audio data sets each having not more than one measure, for example. The rhythm musical performance data sets may be MIDI data.

Any one of the plurality of types of the interval musical performance data sets is allocated to the pitch shift key region N1. The interval musical performance data sets can be pitch-shifted. Specifically, each pitch of the interval musical performance data sets is shifted according to a depressed key in the pitch shift key region N1. When the user depresses a plurality of keys that constitute a chord in the chord detection key region CD, automatic accompaniment data is generated based on the accompaniment style data stored in the storage device 7 of FIG. 1 and the chord.

(3) Functional Configuration of Musical Sound Data Reproduction Device 100

Figure 3:
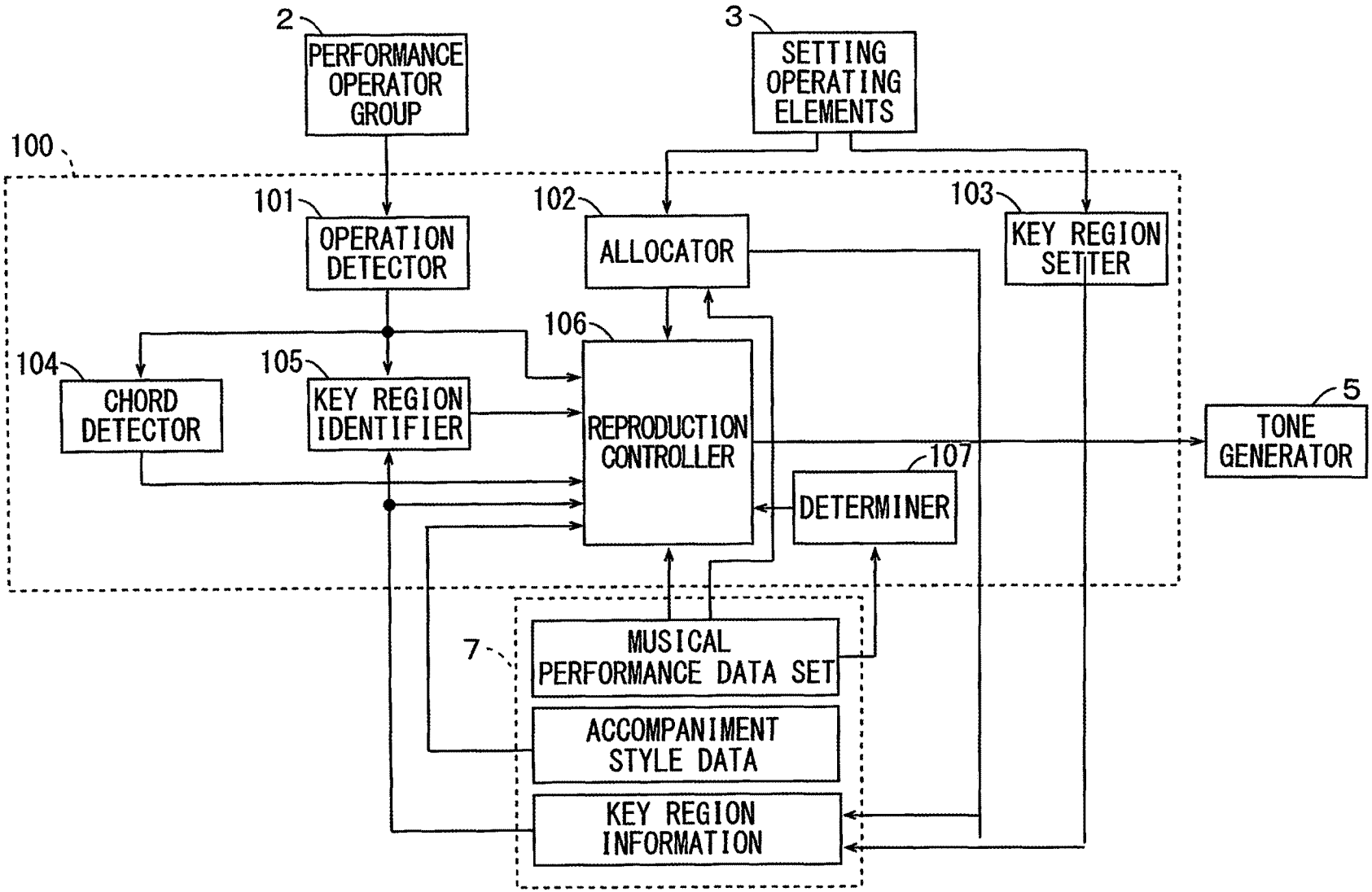
FIG. 3 is a block diagram mainly showing the functional configuration of the musical sound data reproduction device of FIG. 1.

FIG. 3 is a block diagram mainly showing the functional configuration of the musical sound data reproduction device 100 of FIG. 1. As shown in FIG. 3, the musical sound data reproduction device 100 includes an operation detector 101, an allocator 102, a key region setter 103, a chord detector 104, a key region identifier 105, a reproduction controller 106 and a determiner 107. The CPU 8 of FIG. 1 executes the musical sound data reproduction program stored in the storage device 7 or the ROM 11, whereby the function of each constituent element (101 to 107) of the musical sound data reproduction device 100 is realized.

When the user depresses a key in the performance operator group 2, a note-on event (hereinafter abbreviated as a note-on) including the pitch corresponding to the depressed key is generated. The note-on corresponds to an ON state of the key. Further, when the user releases the key in the performance operator group 2, a note-off event (hereinafter abbreviated as a note-off) including the pitch corresponding to the released key is generated. The note-off corresponds to an OFF state of the key. The operation detector 101 detects a note-on and a note-off generated due to an operation of the performance operator group 2.

Based on a user's operation of the setting operating elements 3, the allocator 102 allocates the rhythm musical performance data sets to the rhythm key regions D1 to D6 of FIG. 2, and allocates any of the interval musical performance data sets to the pitch shift key region N1. Based on a user's operation of the setting operating elements 3, the key region setter 103 sets the rhythm key regions D1 to D6, the pitch shift key region N1 and the chord detection key region CD in the performance operator group 2 of FIG. 1. The settings of the key region made by the key region setter 103 and the allocation of the musical performance data sets by the allocator 102 are stored in the storage device 7 as the key region information.

In a case where note-ons in the chord detection key region CD are detected by the operation detector 101, the chord detector 104 detects a chord based on the pitches of the note-ons. The key region identifier 105 identifies the key region to which the pitch of the note-on detected by the operation detector 101 belongs. The determiner 107 determines whether the musical performance data set is the loopable data or the non-loopable data.

The reproduction controller 106 controls the reproduction method of the musical performance data set based on a note-on or a note-off detected by the operation detector 101, the key region identified by the key region identifier 105, the key region information stored in the storage device 7 and a result of determination provided by the determiner 107. Further, the reproduction controller 106 controls the reproduction method of the automatic accompaniment data based on a note-on or a note-off detected by the operation detector 101, the key region identified by the key region identifier 105, the key region information stored in the storage device 7 and the chord detected by the chord detector 104 and the accompaniment style data stored in the storage device 7. Here, reproduction of the musical performance data set or the automatic accompaniment data means outputting the musical performance data set or the automatic accompaniment data to the tone generator 5. When the musical performance data set or the automatic accompaniment data is reproduced by the reproduction controller 106, a musical performance sound on the basis of the musical performance data set or an automatic accompaniment sound on the basis of the automatic accompaniment data is generated from the sound system 6.

In the present embodiment, the reproduction controller 106 carries out first control (a first reproduction mode) and second control (a second reproduction mode) relating to the reproduction method of the musical performance data set based on an operation using a black key BK or a white key WH in the rhythm key regions D1 to D6. The operations using a key include an operation of depressing a key (a key depression) and an operation of releasing a key (a key release). The key is put in an ON state by the operation of depressing the key, and the key is put in an OFF state by the operation of releasing the key. The reproduction method includes loop reproduction and normal reproduction, for example. Further, each of the first control and the second control relating to the reproduction method includes any one of starting the loop reproduction, starting the normal reproduction, stopping the loop reproduction and stopping the normal reproduction, for example. In the present embodiment, the control carried out by an operation using a black key BK in the rhythm key regions D1 to D6 corresponds to the first control, and the control carried out by an operation using a white key WH in the rhythm key regions D1 to D6 corresponds to the second control. The reproduction controller 106 carries out the first control based on the manner in which the state of the black key BK changes and carries out the second control based on the manner in which the state of the white key WH changes. The manner in which the state of a key changes includes one or a combination of two or more from among the key being switched from the ON state to the OFF state, the key being switched from the OFF state to the ON state, the key being kept in the ON state or the OFF state, the key being switched multiple times from the OFF state to the ON state.

(4) Key Region Information

FIG. 4 is a diagram showing one example of the key region information. In the example of FIG. 4, key numbers (MIDI key numbers, for example) are assigned in an ascending order from the key of the lowest pitch to the key of the highest pitch of the keyboard 20 of the performance operator group 2. The chord detection key region CD is set for a plurality of keys of the key numbers "28" to "52," and the pitch shift key region N1 is set for a plurality of keys of the key numbers "53" to "83." The rhythm key regions D1 to D6 are set for a plurality of keys of the key numbers "84" to "103" in order. For example, the rhythm key region D1 is set for the three consecutive keys of the key numbers "84" to "86."

The interval musical performance data set "PA" is allocated to the pitch shift key region N1 as the musical performance data set, and rhythm musical performance data sets "P1" to "P6" are respectively allocated to the rhythm key regions D1 to D6. Each of the rhythm musical performance data sets "P1" to "P6" is the loopable data or the non-loopable data.

(5) One Example of Musical Sound Data Reproduction Method

Figure 5:
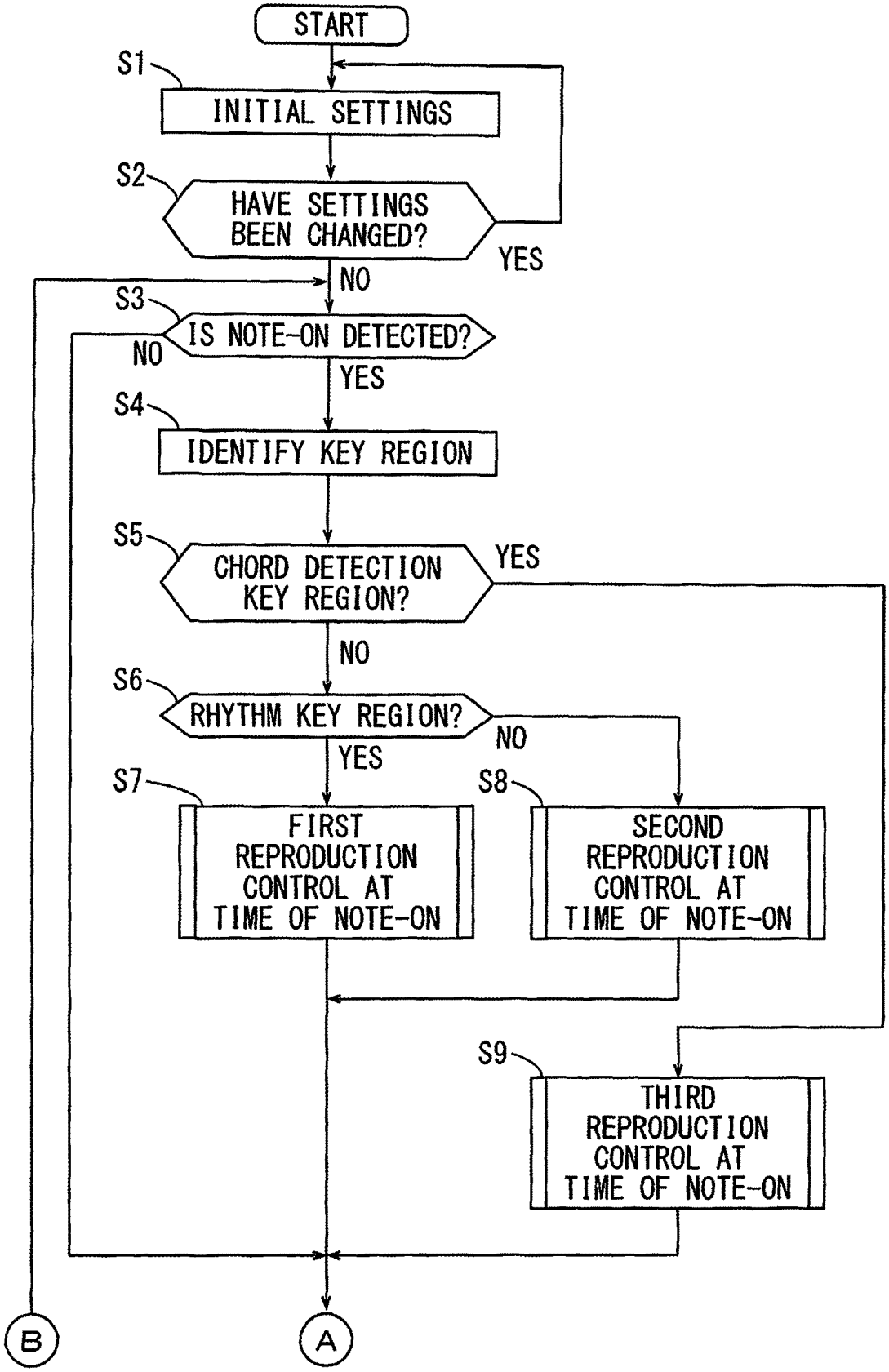
FIG. 5 is a flow chart showing a musical sound data reproduction method in the musical sound data reproduction device of FIG. 2.
Figure 6:
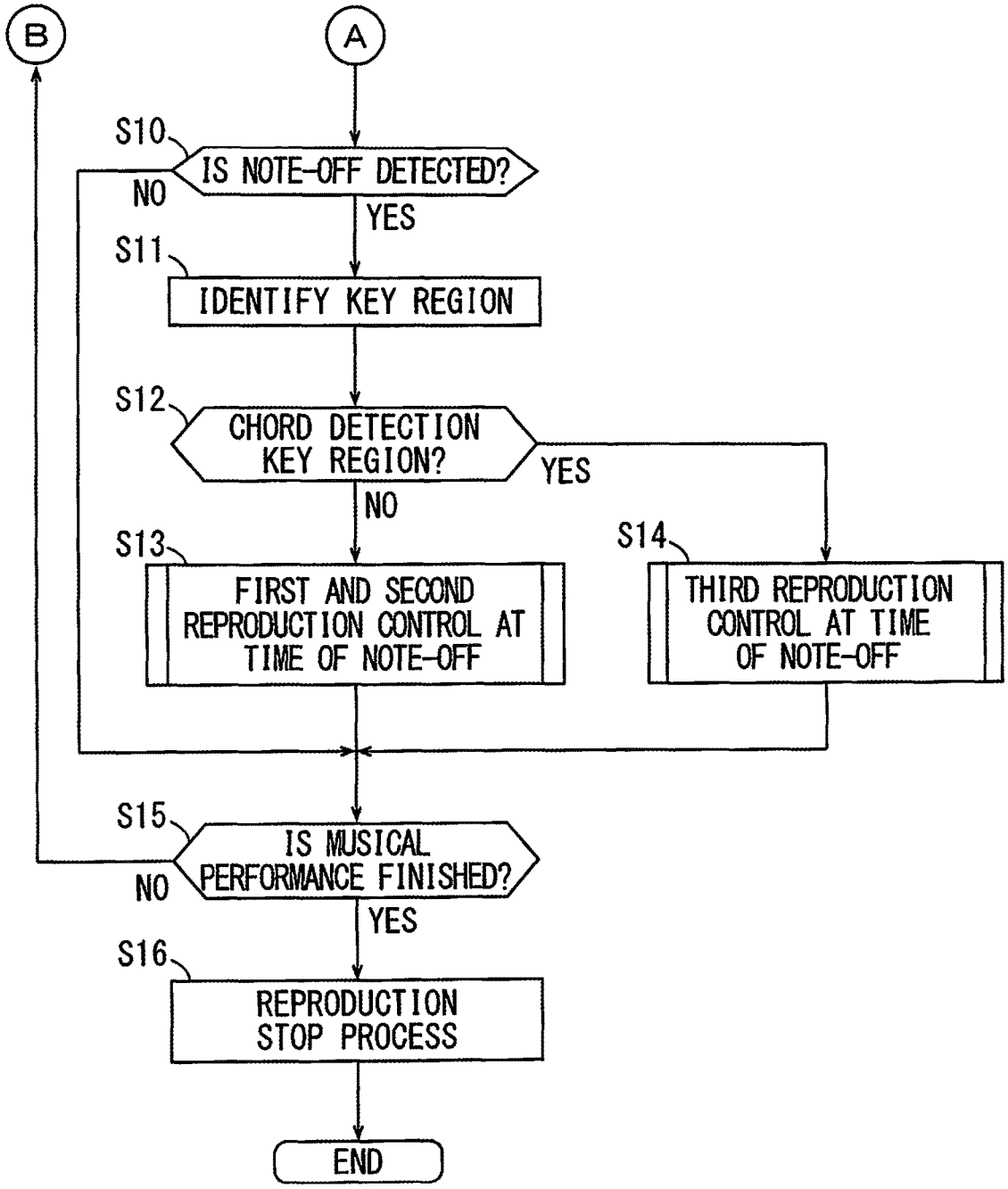
FIG. 6 is a flow chart showing the musical sound data reproduction method in the musical sound data reproduction device of FIG. 2.

FIGS. 5 and 6 are flow charts showing the musical sound data reproduction method in the musical sound data reproduction device 100 of FIG. 2. The CPU 8 of FIG. 1 executes the musical sound data reproduction program stored in the storage device 7 or the ROM 11, whereby the musical sound data reproduction method of FIGS. 5 and 6 is performed. In the following description, any rhythm key region out of the rhythm key regions D1 to D6 is referred to as a rhythm key region Dk. k is any value from 1 to 6.

In the present example, in a case where the rhythm musical performance data set allocated to the rhythm key region Dk is the loopable data, the reproduction control is carried out as follows. When the user depresses any of the one or more black keys BK in the rhythm key region Dk once, the loop reproduction of the rhythm musical performance data set is started. Further, even in a case where the user releases the black key BK, the loop reproduction is continued. When the user re-depresses any of the one or more black keys BK in the rhythm key region Dk or any of the one or more white keys WH in the rhythm key region Dk during the loop reproduction, the loop reproduction is stopped. When the user holds down any of the one or more white keys WH in the rhythm key region Dk during the loop reproduction, the rhythm musical performance data set is reproduced on a loop. Further, when the user releases the white key WH, the loop reproduction is stopped.

On the other hand, in a case where the rhythm musical performance data set allocated to the rhythm key region Dk is the non-loopable data, the reproduction control is carried out as follows. When the user holds down any key (a black key BK or a white key WH) in the rhythm key region Dk, the normal reproduction is performed. The rhythm musical performance data set is reproduced once, and then the reproduction is stopped. When the user releases the key (a white key WH or a black key BK) in the rhythm key region Dk during the normal reproduction, the normal reproduction is stopped.

First, the allocator 102 and the key region setter 103 performs initial settings (step S1). Specifically, the key region setter 103 sets the rhythm key regions D1 to D6, the pitch shift key region N1 and the chord detection key region CD in the keyboard 20 based on an operation using the setting operating elements 3. Further, based on an operation using the setting operating elements 3, the allocator 102 allocates any of the rhythm musical performance data sets to each of the rhythm key regions D1 to D6, allocates any of the interval musical performance data set to the pitch shift key region N1, and selects and sets the accompaniment style data for the chord detection key region CD.

The allocator 102 and the key region setter 103 determines whether an operation of changing the settings by the setting operating elements 3 has been performed (step S2). In a case where the operation of changing the settings has been performed, the allocator 102 and the key region setter 103 return to the step S1.

In a case where the operation of changing the settings is not performed, the operation detector 101 determines whether a note-on has been detected (step S3). In a case where a note-on has been detected, the key region identifier 105 identifies the key region to which the pitch of the note-on belongs (step S4), and determines whether the identified key region is the chord detection key region CD (step S5). In a case where the identified key region is not the chord detection key region CD, the key region identifier 105 determines whether the identified key region is any of the rhythm key regions D1 to D6 (step S6).

Figure 7:
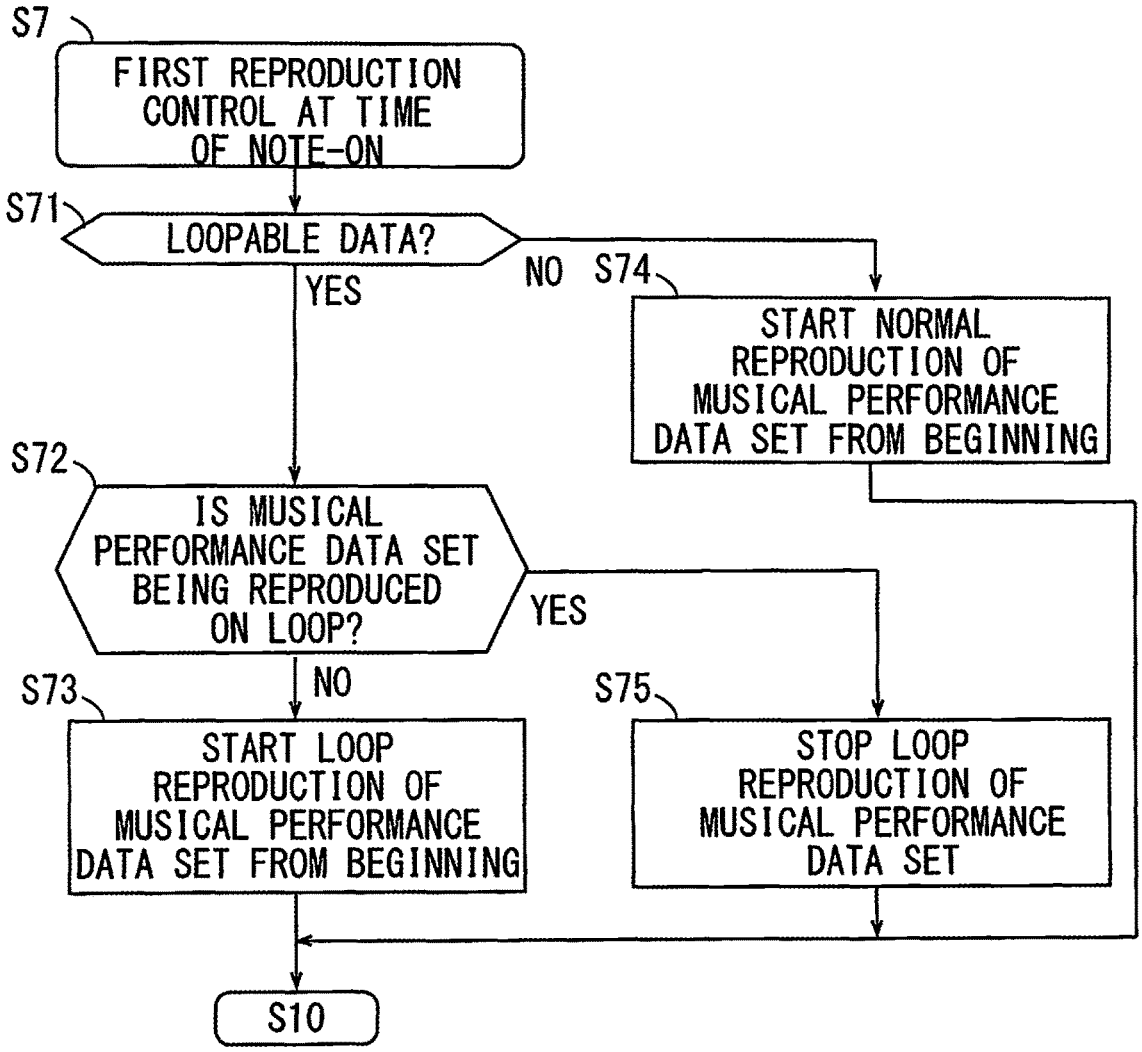
Figure 8:
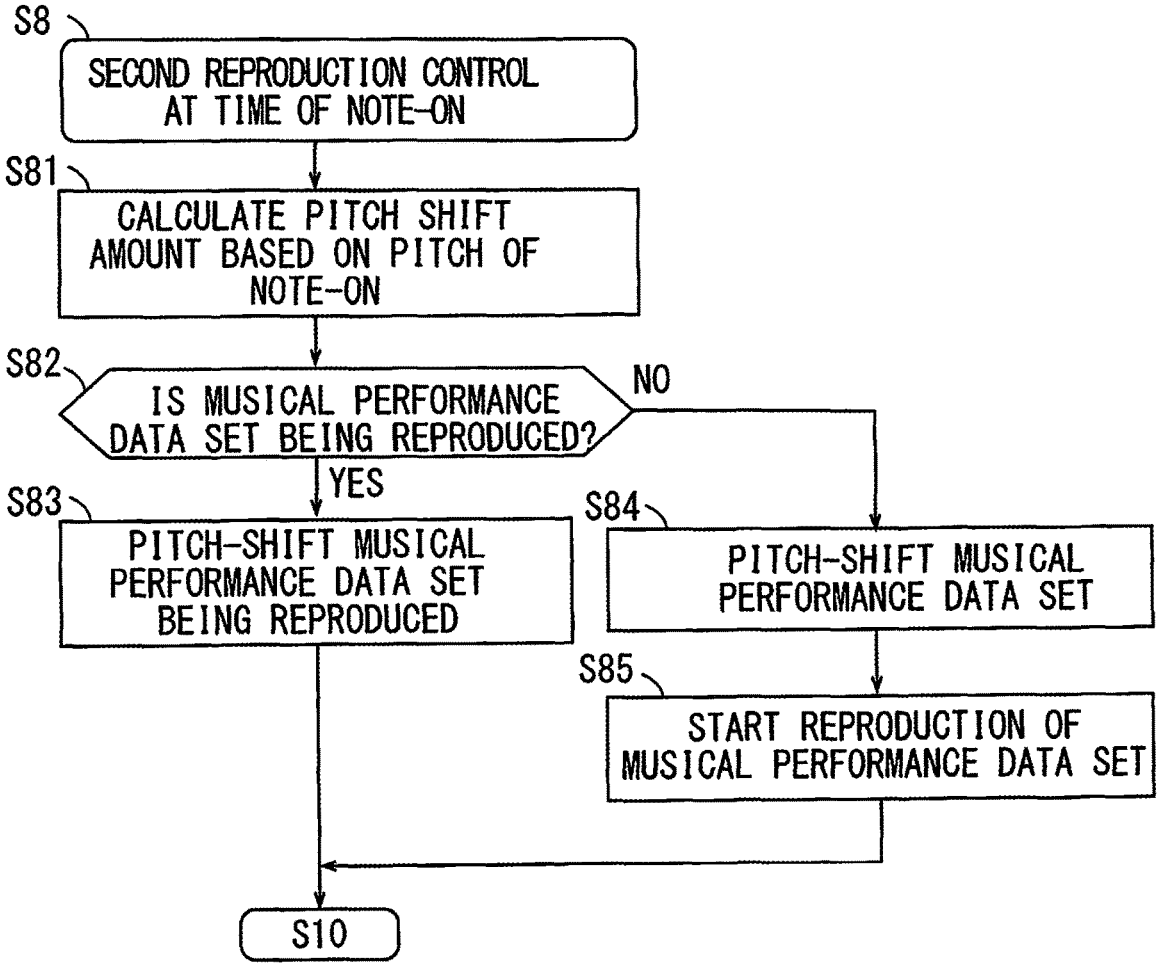
Figure 9:
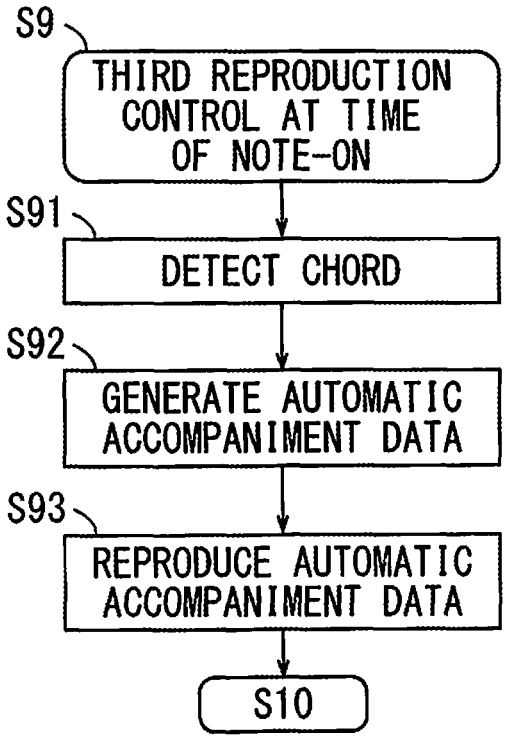

In a case where the identified key region is any of the rhythm key regions D1 to D6, first reproduction control at the time of note-on shown in FIG. 7 is carried out (step S7). In a case where the identified key region is not any of the rhythm key regions D1 to D6 (in a case where the identified key region is the pitch shift key region N1), second reproduction control at the time of note-on shown in FIG. 8 is carried out (step S8). In a case where the identified key region is the chord detection key region CD, third reproduction control at the time of note-on shown in FIG. 9 is carried out (step S9).

Figure 10:
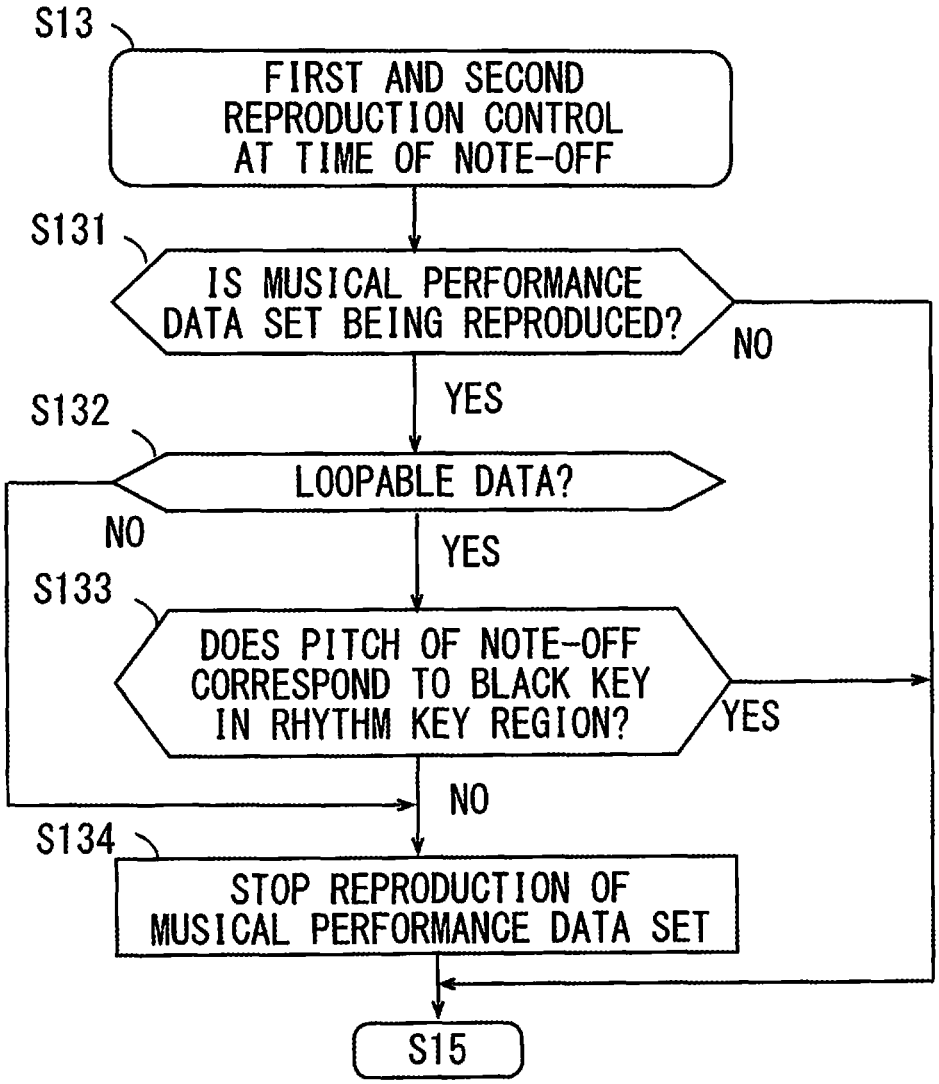
FIG. 10 is a flow chart showing first and second reproduction control to be carried out in case of detection of a note-off.
Figure 11:
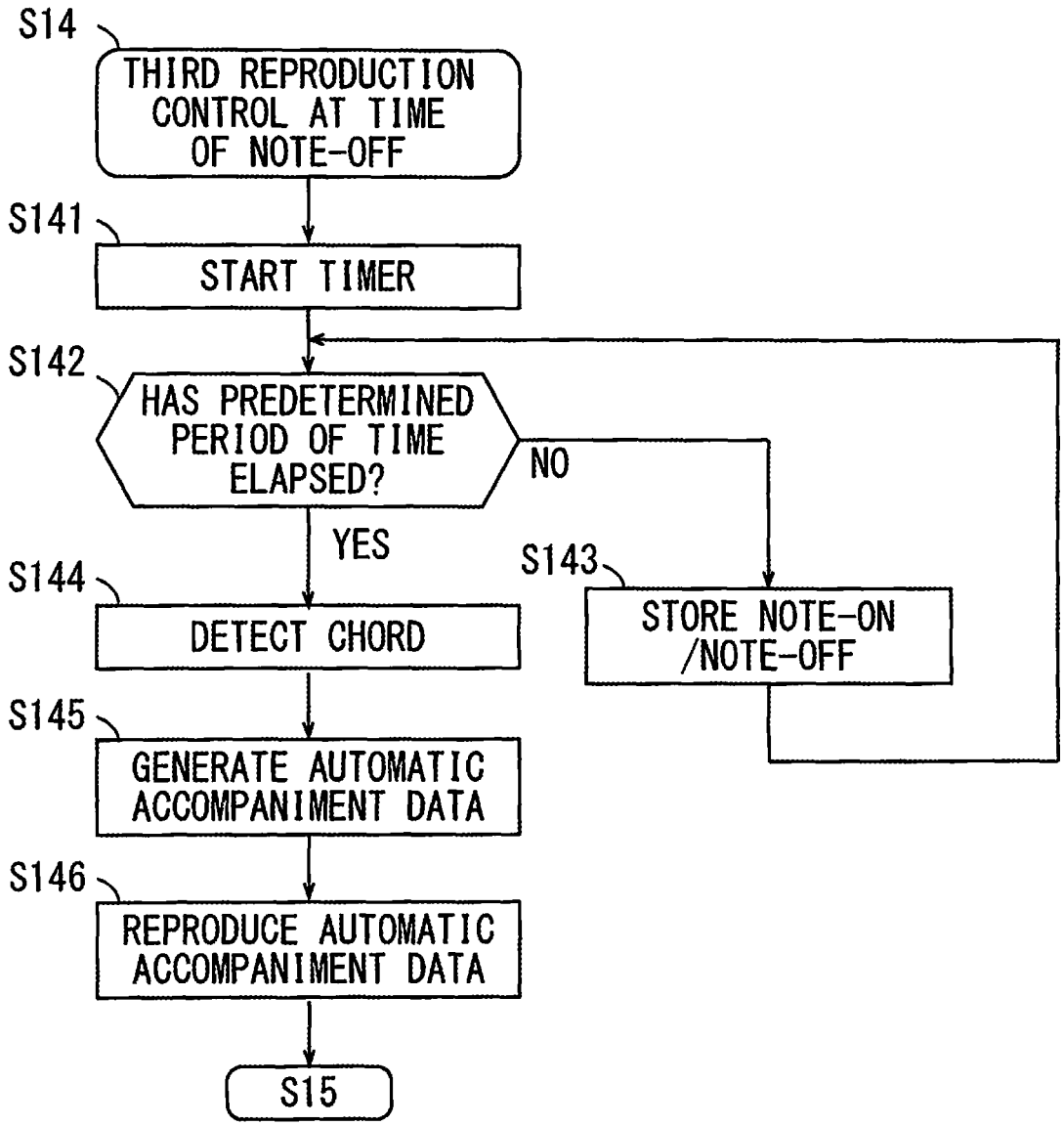
FIG. 11 is a flow chart showing the third reproduction control to be carried out in case of detection of a note-off.

Next, the operation detector 101 determines whether a note-off has been detected (step S10). In a case where a note-off has been detected, the key region identifier 105 identifies the key region to which the pitch of the note-off belongs (step S11), and determines whether the identified key region is the chord detection key region CD (step S12). In a case where the identified key region is not the chord detection key region CD (in a case where the identified key region is any of the rhythm key regions D1 to D6 or the pitch shift key region N1), first and second reproduction control at the time of note-off shown in FIG. 10 are carried out (step S13). In a case where the identified key region is the chord detection key region CD, the third reproduction control at the time of note-off shown in FIG. 11 is carried out (step S14).

Thereafter, the reproduction controller 106 determines whether an instruction for ending musical performance has been provided by the setting operating elements 3 (step S15). In a case where the instruction for ending the musical performance has not been provided, the reproduction controller 106 returns to the step S3, and the process of the steps S3 to S15 is repeated. In a case where the instruction for ending the musical performance has been provided, the reproduction controller 106 performs a reproduction stop process (step S16). In the reproduction stop process, the reproduction of the musical performance data set and the automatic accompaniment data is stopped.

FIG. 7 is a flow chart showing the first reproduction control at the time of note-on. In a case where a note-on is detected in the step S3 when the user depresses a key in the rhythm key regions D1 to D6, the first reproduction control at the time of note-on in FIG. 7 is carried out. The determiner 107 determines whether the rhythm musical performance data set allocated to the rhythm key region Dk is the loopable data based on the key region information (step S71).

In a case where the rhythm musical performance data set is the loopable data, the reproduction controller 106 determines whether the rhythm musical performance data set is being reproduced on a loop (step S72). In a case where the rhythm musical performance data set is not being reproduced on a loop (in a case where the reproduction of the rhythm musical performance data set is being stopped), the reproduction controller 106 starts the loop reproduction of the rhythm musical performance data set from the beginning (step S73) and proceeds to the step S10 of FIG. 6. Thus, the user can start the loop reproduction of the rhythm musical performance data set by depressing a black key BK or a white key WH in the rhythm key region DK while the reproduction of the rhythm musical performance data set, which is the loopable data, is being stopped.

Even in a case where the loop reproduction is started by depression of a black key BK in the rhythm key region Dk, and then the black key BK is released, the loop reproduction is continued. On the other hand, in a case where the loop reproduction is started by depression of a white key WH in the rhythm key region Dk, and then the white key WH is released, the loop reproduction is stopped. In a case where the rhythm musical performance data set is being reproduced on a loop in the step S72, the reproduction controller 106 stops the loop reproduction of the rhythm musical performance data set (step S75) and proceeds to the step S10 of FIG. 6. Thus, the user can stop the reproduction of the rhythm musical performance data set by depressing a black key BK or a white key WH in the rhythm key region Dk while the rhythm musical performance data set is being reproduced on a loop.

In a case where the rhythm musical performance data set is the non-loopable data in the step S71, the reproduction controller 106 starts the normal reproduction of the rhythm musical performance data set from the beginning (step S74) and proceeds to the step S10. Thus, the user can start the normal reproduction of the rhythm musical performance data set from the beginning by depressing a black key BK or a white key WH in the rhythm key region Dk while the rhythm musical performance data set, that is the non-loopable data, is being reproduced or is being stopped.

FIG. 8 is a flow chart showing the second reproduction control at the time of note-on. In a case where a note-on is detected in the step S3 when the user depresses a key in the pitch shift key region N1, the second reproduction control at the time of note-on in FIG. 8 is carried out. The reproduction controller 106 calculates a pitch shift amount based on a reference key of the interval musical performance data set, which is allocated to the pitch shift key region N1 based on the key region information, and the pitch of the note-on (step S81). Further, the reproduction controller 106 determines whether the interval musical performance data set is being reproduced (step S82). In a case where the interval musical performance data set is being reproduced, the interval musical performance data set being reproduced is pitch-shifted based on the calculated pitch shift amount (step S83), and the production controller 106 proceeds to the step S10. Thus, the user can shift the pitch of the interval musical performance data set being reproduced in accordance with a desired key by depressing the key in the pitch shift key region N1 while the interval musical performance data set is being reproduced.

In a case where the interval musical performance data set is not being reproduced in the step S82, the reproduction controller 106 performs pitch shift of the interval musical performance data set based on the calculated pitch shift amount (step S84), starts the reproduction of the pitch-shifted interval musical performance data set (step S85) and proceeds to the step S10. Thus, the user can start the reproduction of the interval musical performance data set at the pitch corresponding to a desired key by depressing the key in the pitch shift key region N1 while the reproduction of the interval musical performance data set is being stopped. The process of the steps S84, 85 may be performed each time a note-on in the pitch shift key region N1 is detected. In this case, the steps S82, S83 are not provided, and the process of the steps S84, S85 is performed following the step S81.

FIG. 9 is a flow chart showing the third reproduction control at the time of note-on. In a case where a note-on is detected in the step S3 when the user depresses a plurality of keys in the chord detection key region CD, the third reproduction control at the time of note-on in FIG. 9 is carried out. The chord detector 104 detects a chord based on the pitches of the note-ons (step S91). The reproduction controller 106 generates automatic accompaniment data based on the detected chord and preset accompaniment style data (step S92), reproduces the generated automatic accompaniment data (step S93) and proceeds to the step S10. Thus, the user can reproduce the automatic accompaniment data corresponding to the chord by depressing a plurality of keys in the chord detection key region CD.

FIG. 10 is a flow chart showing the first and second reproduction control at the time of note-off. In a case where a note-off is detected in the step 10 when the user releases a key in the rhythm key regions D1 to D6 or a key in the pitch shift key region N1, the first and second reproduction control at the time of note-off in FIG. 10 are carried out.

The reproduction controller 106 determines whether the musical performance data set (the rhythm musical performance data set or the interval musical performance data set) allocated to the identified rhythm key region Dk or the identified pitch shift key region N1 is being reproduced (step S131). In a case where the musical performance data set is being reproduced, the determiner 107 determines whether the musical performance data set being reproduced is the loopable data based on the key region information (step S132). In a case where the musical performance data set being reproduced is the loopable data, the reproduction controller 106 determines whether the pitch of the note-off corresponds to a black key BK in the rhythm key region Dk (step S133). In a case where the pitch of the note-off does not correspond to a black key BK in the rhythm key region Dk, that is, in a case where the pitch of the note-off corresponds to a white key WH in the rhythm key region Dk, or corresponds to a black key BK or a white key WH in the pitch shift key region N1, the reproduction controller 106 stops the reproduction of the musical performance data set (step S134) and proceeds to the step S15. In a case where the musical performance data set being reproduced in the step S132 is the non-loopable data, the reproduction controller 106 stops the reproduction of the musical performance data set (step S134) and proceeds to the step S15. Thus, the user can stop the reproduction of the musical performance data set by releasing a white key WH during the loop reproduction or the normal reproduction of the rhythm musical performance data set in the rhythm key region Dk, or by releasing a key (a black key BK or a white key WH) during the reproduction of the interval musical performance data set in the pitch shift key region N1.

On the other hand, in a case where the pitch of the note-off corresponds to a black key BK in the rhythm key region Dk in the step S133, the reproduction controller 106 proceeds to the step S15 without stopping the reproduction of the musical performance data set. Thus, even if the user releases the black key BK during the loop reproduction of the rhythm musical performance data set, the loop reproduction can be continued. In a case where the musical performance data set is not being reproduced in the step S131, the reproduction controller 106 proceeds to the step S15.

FIG. 11 is a flow chart showing the third reproduction control at the time of note-off. In a case where a note-off is detected in the step S10 when the user releases a key in the chord detection key region CD, the third reproduction control at the time of note-off in FIG. 11 is carried out.

The reproduction controller 106 starts the timer 9 (step S141), and determines whether a predetermined period of time has elapsed (step S142). While the predetermined period of time is a thirty-second note, for example, the present invention is not limited to this. In a case where the predetermined period of time has not elapsed, the reproduction controller 106 stores a note-on and a note-off detected by the operation detector 101 (step S143). In a case where the predetermined period of time has elapsed, the chord detector 104 detects a chord based on the pitches not belonging to note-off (the pitches that belong to note-ons when the predetermined period of time elapses) among the stored note-ons (step S144). The reproduction controller 106 generates automatic accompaniment data based on the detected chord and the preset accompaniment style data (step S145), reproduces the generated automatic accompaniment data (step S146) and proceeds to the step S15. Thus, the user can change the automatic accompaniment data by changing from depressing the key, which has been depressed in the chord detection key region CD during the reproduction of the automatic accompaniment data, to depressing another key. In a case where any pitch of a note-on is not stored in the predetermined period of time, it is detected in the step S144 that the chord has not been changed, and the reproduction of the automatic accompaniment data is continued in the step S146. In this case, the chord that is detected previously or immediately before is maintained.

(6) Effects of Embodiments

With the musical sound data reproduction device 100 and the musical sound data reproduction method according to the present embodiment, the first control relating to the reproduction method of musical sound data is carried out in response to detection of an operation using a black key BK in the rhythm key regions D1 to D6. Further, the second control relating to the reproduction method of musical sound data is carried out in response to detection of an operation using a white key WH in the rhythm key regions D1 to D6. In this case, it is not necessary for the user to operate a switch, a button or the like other than the keyboard 20 of the performance operator group 2 during musical performance. Thus, it is possible to easily switch the control relating to the reproduction method of musical sound data during musical performance without interrupting the musical performance.

Further, the user can carry out any one of starting of the loop reproduction of musical sound data, starting of the normal reproduction (one-time reproduction) of the musical sound data, stopping of the loop reproduction of the musical sound data and stopping of the one-time reproduction of the musical sound data by operating a black key BK or a white key WH in the rhythm key regions D1 to D6. Thus, the user can switch the reproduction between the loop reproduction and the normal reproduction by a simple operation during musical performance.

Further, the user can reproduce the musical sound data on the basis of a desired pitch while shifting the pitch of the musical sound data allocated to the pitch shift key region N1 by operating a desired key in the pitch shift key region N1. In this case, the user can easily switch the reproduction of the rhythm musical performance data set between the loop reproduction and the normal reproduction while performing music based on the interval musical performance data set on the basis of any pitch by operating the pitch shift key region N1 and the rhythm key regions D1 to D6.

Further, because the rhythm key regions D1 to D6 are set in a sound range higher than the sound range of the pitch shift key region N1, it is possible to easily operate the rhythm key regions D1 to D6 while performing music by operating the pitch shift key region N1. Even in a case where the rhythm key regions D1 to D6 are set in a sound range lower than the sound range of the pitch shift key region N1, the user can perform music using both of the rhythm key regions D1 to D6 and the pitch shift key region N1. In a case where the pitch shift key region N1 is set in the sound range of about F2 to C5, which is used for performing a regular melody, the user can easily perform music.

Further, because the chord detection key region CD can be set in the keyboard 20 of the performance operator group 2, the user can easily switch rhythm sounds by operating a key in the rhythm key regions D1 to D6 while performing an automatic accompaniment on the basis of the chord by operating keys in the chord detection key region CD. In general electronic keyboard musical instruments of the same type as the type of the electronic musical apparatus 1 according to the present embodiment, the chord detection region is provided in a lower sound range (the left side). Therefore, the user can easily perform music using the rhythm key regions D1 to D6 or the pitch shift key region N1 while performing an automatic accompaniment by chord musical performance using the musical performance method similar to that of the general electronic keyboard musical instruments.

Further, the loop reproduction or the normal reproduction is started or stopped based on the result of determination whether any of the musical performance data sets allocated to the rhythm key regions D1 to D6 is the loopable data or the non-loopable data and the manner in which the state of a black key BK or a white key WH changes. Thus, the user can easily switch the reproduction between the loop reproduction and the normal reproduction by an operation of depressing a black key BK and a white key WH in the rhythm key regions D1 to D6.

Further, in a case where the musical sound data is the loopable data, the user can start the loop reproduction by depressing a black key BK and stop the loop reproduction by re-depressing the black key BK. Thus, the user can easily operate to start and stop the loop reproduction by operating a black key BK during musical performance.

Further, in a case where the musical sound data is the loopable data, the user can continue the loop reproduction only while a white key WH is being held down. Thus, the user can easily operate starting and stopping of the loop reproduction by operating a white key WH during musical performance.

In the present embodiment, the musical sound data reproduction device 100 further includes the storage device 7 (storage) that stores the key region information for specifying the rhythm key regions D1 to D6 (the first key region) and other key regions set in the performance operator group 2, and the key region identifier 105 that identifies whether the detection of an operation by the operation detector 101 is the detection of an operation of the rhythm key regions D1 to D6 or the detection of an operation of another region, based on the key region information stored in the storage device 7. Therefore, the reproduction controller 106 can easily identify an operation of the rhythm key regions D1 to D6 and an operation of another region.

(7) Another Example of Musical Sound Data Reproduction Method

Figure 12:
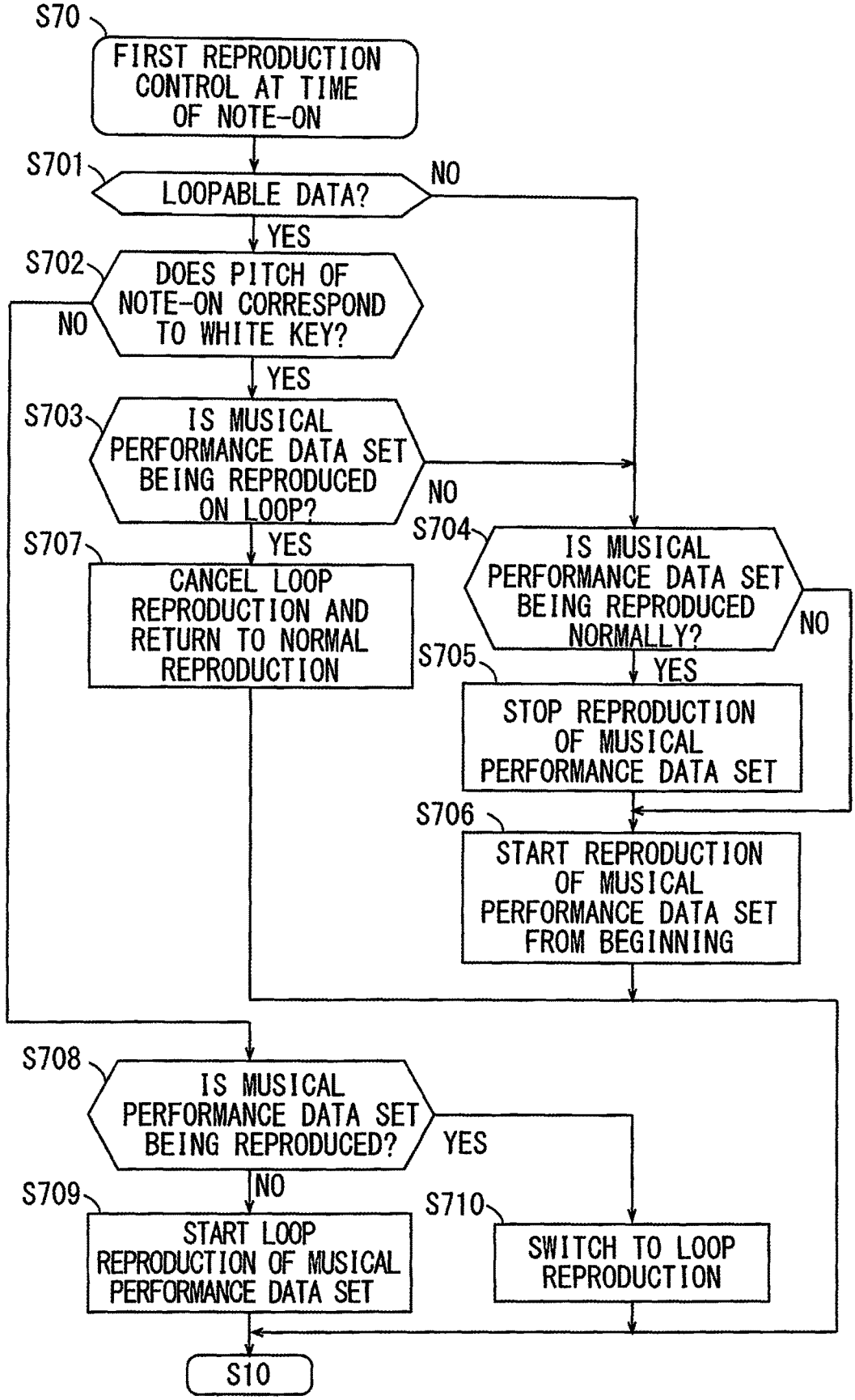
FIG. 12 is a flow chart showing another example of the first reproduction control to be carried out in a case where a key in a rhythm key region is operated.

FIG. 12 is a flow chart showing another example of the first reproduction control in a case where a key in the rhythm key regions D1 to D6 is operated. The first reproduction control of FIG. 12 is carried out instead of the step S7 of FIG. 5.

In a case where a note-on is detected in the step S3 of FIG. 5 when the user depresses a key in the rhythm key regions D1 to D6, the determiner 107 determines whether the rhythm performance data set allocated to the rhythm key region Dk is the loopable data based on the key region information (step S701).

In a case where the musical performance data set is the loopable data, the reproduction controller 106 determines whether the pitch of a note-on corresponds to a white key WH (step S702). In a case where the pitch of the note-on corresponds to a white key WH, the reproduction controller 106 determines whether the rhythm musical performance data set is being reproduced on a loop (step S703).

In a case where the rhythm musical performance data set is not being reproduced on a loop, the reproduction controller 106 determines whether the rhythm musical performance data set is being reproduced normally (step S704). In a case where the rhythm musical performance data set is not being reproduced normally, the reproduction controller 106 starts the reproduction of the rhythm musical performance data set from the beginning (step S706). In a case where the rhythm musical performance data set is being reproduced normally in the step S704, the reproduction controller 106 stops the reproduction of the rhythm musical performance data set (step S705), and starts the reproduction of the rhythm musical performance data set from the beginning (step S706). In a case where the rhythm musical performance data set is being reproduced on a loop in the step S703, the reproduction controller 106 cancels the loop reproduction and returns to the normal reproduction (step S707).

Thus, the user can start the normal reproduction from the beginning by depressing a white key WH while the reproduction of the rhythm musical performance data set is being stopped. Further, the user can start the reproduction of the rhythm musical performance data set from the beginning by depressing a white key WH while the rhythm musical performance data set is being reproduced normally. Further, the user can switch the loop reproduction to the normal reproduction by depressing a white key WH while the rhythm musical performance data set is being reproduced on a loop. In the normal reproduction, when the rhythm musical performance data set is reproduced to the end, the reproduction ends. In a case where the rhythm musical performance data set is being reproduced normally in the step S704, the steps S705, S706 may be skipped. In this case, even in a case where the user depresses a white key WH while the rhythm musical performance data set is being reproduced normally, the normal reproduction continues.

In a case where the pitch of a note-on does not correspond to a white key WH in the step S702 (the pitch corresponds to a black key BK), the reproduction controller 106 determines whether the rhythm musical performance data set is being reproduced (step S708). In a case where the rhythm musical performance data set is not being reproduced, the reproduction controller 106 starts the loop reproduction of the rhythm musical performance data set (step S709). In a case where the rhythm musical performance data set is being reproduced, the reproduction controller 106 switches the reproduction of the rhythm musical performance data set to the loop reproduction (step S710). In a case where the rhythm musical performance data set is being reproduced on a loop in the step S708, the reproduction controller 106 continues the loop reproduction.

Thus, the user can start the loop reproduction by depressing a black key BK while the reproduction of the rhythm musical performance data set is being stopped. Further, the user can switch the normal reproduction to the loop reproduction by depressing a black key BK during the normal reproduction of the rhythm musical performance data set. The reproduction controller 106 may switch the loop reproduction to the normal reproduction in a case where a black key BK is depressed while the rhythm musical performance data set is being reproduced on a loop.

In a case where the rhythm musical performance data set is not the loopable data (in a case where the rhythm musical performance data set is the non-loopable data) in the step S701, the reproduction controller 106 determines whether the rhythm musical performance data set is being reproduced (step S704). In a case where the rhythm musical performance data set is being reproduced normally, the reproduction controller 106 stops the reproduction of the rhythm musical performance data set (step S705), and starts the reproduction of the rhythm musical performance data set from the beginning (step S706). In a case where the rhythm musical performance data set is not being reproduced normally, the reproduction controller 106 starts the reproduction of the rhythm musical performance data set from the beginning (step S706).

Thus, the user can start the normal reproduction of the rhythm musical performance data set from the beginning by depressing a black key BK or a white key WH while the reproduction of the rhythm musical performance data set, which is the non-loopable data, is being stopped. Further, the user can start the normal reproduction of the rhythm musical performance data set from the beginning by depressing a black key BK or a white key WH while the rhythm musical performance data set, which is the non-loopable data, is being reproduced normally.

(8) Other Embodiments

The function of the black keys BK and the function of the white keys WH in the rhythm key regions D1 to D6 in the above-mentioned embodiment may be reversed to each other. It is preferable that the function of the black keys BK and the function of the white keys WH are respectively common among the plurality of rhythm key regions D1 to D6. Thus, the user can easily recognize the function of the black keys BK and the function of the white keys WH.

The rhythm key regions D1 to D6 may be settable by the user, or may be fixed in advance. The number of the black keys BK and the white keys WH included in each rhythm key region Dk is not limited to the above-mentioned embodiment. Each rhythm key region may include any number, which is one or more, of the black keys BK, and any number, which is one or more, of the white keys WH.

The keyboard-shaped performance operator group 2 is not limited to be in a keyboard-shape, and may include performance operators arranged in a row such as a plurality of pads that form a scale. In this case, part of the plurality of performance operators corresponds to white keys having names of musical note not provided with "#" and "♭," and the rest of the plurality of performance operators correspond to black keys having names of musical note provided with "#" and "♭." The number of the rhythm key regions D1 to D6 is not limited to the above-mentioned embodiment. In the keyboard 20, only one rhythm key region may be set, or any number of a plurality of rhythm key regions may be set. Instead of the pitch shift key region N1 or the chord detection key region CD, a key region for normal musical performance of generating a single sound corresponding to a key by depression of each key may be set.

While the reproduction method of musical sound data is the method of the loop reproduction and normal reproduction in the above-mentioned embodiment, the reproduction method of the present invention is not limited to this. The reproduction method of musical sound data may be another reproduction method except for only differences of pitches. For example, the reproduction method may be the method of switching types of acoustic effects or adjusting acoustic effects. In this case, it is possible to switch the types of the acoustic effects or adjust the acoustic effects by operating a black key BK or a white key WH in the rhythm key regions D1 to D6.

While the musical sound data is musical performance data sets representing musical performance sounds or automatic accompaniment data representing an accompaniment sound in the above-mentioned embodiment, the musical sound data may be singing data representing a singing voice. The musical sound data reproduction device of the present invention can be applied to not only an electronic keyboard musical instrument but also an electronic device such as a smartphone, a tablet terminal or a personal computer. In this case, a keyboard-shaped performance operator group may be displayed on a screen, or a keyboard-shaped performance operator group may be connected to an electronic device.

As each of various elements recited in the claims, various other elements having configurations or functions described in the claims can be also used.

While preferred embodiments of the present invention have been described above, it is to be understood that variations and modifications will be apparent to those skilled in the art without departing the scope and spirit of the present invention. The scope of the present invention, therefore, is to be determined solely by the following claims.

We claim:

1. A musical sound data reproduction device comprising:

a performance operator group including:

a plurality of first and second performance operators respectively corresponding to a plurality of black and white keys arranged in a row; and a first key region including at least one first performance operator and at least one second performance operator among the plurality of first and second performance operators;

a memory storing instructions; and a processor that implements the instructions to execute a plurality of tasks, including:

an allocating task that allocates first musical sound data to the first key region;

an operation detecting task that detects an operation of each of the plurality of first and second performance operators of the performance operator group; and a reproduction controlling task that selects:

a first reproduction mode for the allocated first musical sound data in response to detection of an operation using one performance operator among the first and second performance operators in the first key region; and a second reproduction mode for the allocated first musical sound data, different from the first reproduction mode, in response to detection of an operation using another performance operator among the first and second performance operators in the first key region, wherein the allocated first musical sound data includes musical performance data that is reproducible in a loop and includes a rhythm pattern, wherein a loop reproduction of the musical performance data in a loop automatically and repetitively reproduces the musical performance data multiple times, and wherein at least one of the first reproduction mode or the second reproduction mode includes starting of the loop reproduction or stopping of the loop reproduction.

2. The musical sound data reproduction device according to claim 1, wherein each of the first and second reproduction modes includes one of starting of the loop reproduction of the musical performance data or stopping of the loop reproduction of the musical performance data.

3. The musical sound data reproduction device according to claim 2, wherein:

the plurality of tasks include a determining task that determines whether the allocated first musical sound data is reproducible in a loop, each of the first and second performance operators of the first key region is switchable between an ON state and an OFF state by an operation thereof, and the reproduction controlling task selects:

the first reproduction mode based on a result of determination by the determining task and a changing state of the one performance operator; and the second reproduction mode based on the result of determination by the determining task and a changing state of the another performance operator.

4. The musical sound data reproduction device according to claim 3, wherein the reproduction controlling task, in a case where the determining task determines that the allocated first musical sound data is reproducible in a loop:

starts the loop reproduction of the musical performance data in response to first switching of the one performance operator to the ON state; and stops the loop reproduction of the musical performance data in response to second switching of the one performance operator to the ON state.

5. The musical sound data reproduction device according to claim 3, wherein the reproduction controlling task, in a case where the determining task determines that the allocated first musical sound data is reproducible in a loop:

starts the loop reproduction of the musical performance data while the another performance operator is kept in the ON state; and stops the loop reproduction of the musical performance data in response to switching of the another performance operator to the OFF state.

6. The musical sound data reproduction device according to claim 1, wherein:

the performance operator group further includes a second key region that includes another first and second performance operators, among the plurality of first and second performance operators, associated with pitches different from the first and second performance operators associated with the first key region, the allocating tasks also allocates second musical sound data to the second key region, the reproduction controlling task, in response to detection of an operation using each of the another first and second performance operators in the second key region:

shifts the pitch of the allocated second musical sound data based on the pitch corresponding to an operated another first or second performance operator thereof; and reproduces the allocated second musical sound data having the shifted pitch.

7. The musical sound data reproduction device according to claim 6, wherein the first key region produces higher pitches than the second key region.

8. The musical sound data reproduction device according to claim 6, wherein:

the performance operator group further includes a third key region that includes yet another first and second performance operators, among the plurality of first and second performance operators, associated with different pitches from the first and second key regions, the allocating tasks also allocates third musical sound data to the third key region, and the reproduction controlling task, in response to detection of an operation using each of the yet another first and second performance operators in the third key region:

detects a chord based on the pitch corresponding to an operated yet another first or second performance operator thereof; and reproduces the allocated third musical sound data on the basis of the detected chord.

9. A musical sound data reproduction device comprising:

a performance operator group including:

a plurality of first and second performance operators respectively corresponding to a plurality of black and white keys arranged in a row; and a first key region including at least one first performance operator and at least one second performance operator among the plurality of first and second performance operators;

an allocator configured to allocate musical sound data to the first key region;

an operation detector configured to detect an operation of each of the plurality of first and second performance operators of the performance operator group; and a reproduction controller configured to select:

a first reproduction mode for the allocated musical sound data in response to detection of an operation of one performance operator among the first and second performance operators in the first key region; and a second reproduction mode for the allocated musical sound data, different from the first reproduction mode, in response to detection of an operation of another performance operator among the first and second performance operators in the first key region, wherein the allocated musical sound data includes musical performance data that is reproducible in a loop and includes a rhythm pattern, wherein a loop reproduction of the musical performance data in a loop automatically and repetitively reproduces the musical performance data multiple times, and wherein at least one of the first reproduction mode or the second reproduction mode includes starting of the loop reproduction or stopping of the loop reproduction.

10. A musical sound data reproduction method comprising:

allocating first musical sound data to a first key region including at least one first performance operator and at least one second performance operator in a performance operator group including a plurality of first and second performance operators that respectively correspond to a plurality of black and white keys arranged in a row;

detecting an operation of each of the plurality of first and second performance operators of the performance operator group;

selecting a first reproduction mode of the allocated first musical sound data in response to detection of an operation of one performance operator among the first and second performance operators in the first key region; and selecting a second reproduction mode of the allocated first musical sound data different from the first control in response to detection of an operation of another performance operator among the first and second performance operators in the first key region, wherein the allocated first musical sound data includes musical performance data that is reproducible in a loop and includes a rhythm pattern, wherein a loop reproduction of the musical performance data in a loop automatically and repetitively reproduces the musical performance data multiple times, and wherein at least one of the first reproduction mode or the second reproduction mode includes starting of the loop reproduction or stopping of the loop reproduction.

11. The musical sound data reproduction method according to claim 10, wherein each of the first and second reproduction modes includes one of starting of the loop reproduction of the musical performance data or stopping of the loop reproduction of the musical performance data.

12. The musical sound data reproduction method according to claim 10, wherein:

the performance operator group further includes a second key region that includes another first and second performance operators, among the plurality of first and second performance operators, associated with pitches different from the first and second performance operators associated with the first key region, the allocating also includes allocating second musical sound data to the second key region, and the musical sound data reproduction method further includes, in response to detection of an operation using each of the another first and second performance operators in the second key region:

shifting the pitch of the allocated second musical sound data based on the pitch corresponding to an operated another first or second performance operator thereof; and reproducing the allocated second musical sound data having the shifted pitch.

13. The musical sound data reproduction method according to claim 12, wherein the first key region produces higher pitches than the second key region.

14. The musical sound data reproduction method according to claim 12, wherein:

the performance operator group further includes a third key region that includes yet another first and second performance operators, among the plurality of first and second performance operators, associated with different pitches from the first and second key regions, the allocating also includes allocating third musical sound data to the third key region, and the musical sound data reproduction method further includes, in response to detection of an operation using each of the first and second performance operators in the third key region:

detecting a chord based on the pitch corresponding to an operated yet another first or second performance operator thereof; and reproducing the allocated third musical sound data based on the detected chord.

15. A musical sound data reproduction method comprising:

allocating musical sound data to a first key region including at least one first performance operator and at least one second performance operator in a performance operator group including a plurality of first and second performance operators that respectively correspond to a plurality of black and white keys arranged in a row;

detecting an operation of each of the plurality of first and second performance operators of the performance operator group;

selecting a first reproduction mode of the allocated musical sound data in response to detection of an operation of one performance operator among the first and second performance operators in the first key region; and selecting a second reproduction mode of the allocated musical sound data different from the first control in response to detection of an operation of another performance operator among the first and second performance operators in the first key region, wherein the allocated musical sound data includes musical performance data that is reproducible in a loop, wherein each of the first and second reproduction modes includes any one of:

starting of a loop reproduction of the musical performance data;

starting of a one-time reproduction of the musical sound data;

stopping of the loop reproduction of the musical performance data; or stopping of the one-time reproduction of the musical sound data;

determining whether the allocated musical sound data allocated to the first key region is reproducible on a loop, wherein each of the first and second performance operators of the first region is switchable between an ON state and an OFF state by an operation thereof, and wherein the selecting of the first reproduction mode selects the first reproduction mode based on a result of the determination and a changing state of the one performance operator, and wherein the selecting of the second reproduction mode selects the second reproduction mode based on a result of the determination and a changing state of the another performance operator.

16. The musical sound data reproduction method according to claim 15, further including, in a case where the allocated musical sound data is determined to be reproducible in a loop:

starting the loop reproduction of the musical performance data in response to first switching of the one performance operator to the ON state; and stopping the loop reproduction of the musical performance data in response to second switching of the one performance operator to the ON state.

17. The musical sound data reproduction method according to claim 15, further including, in a case where the allocated musical sound data is determined to be reproducible in a loop:

starting the loop reproduction of the musical performance data while the another performance operator is being kept in the ON state; and stopping the loop reproduction of the musical performance data in response to switching of the another performance operator to the OFF state.

* * * * *